US011316277B2

(12) United States Patent
Luo et al.

(10) Patent No.: US 11,316,277 B2
(45) Date of Patent: Apr. 26, 2022

(54) LENS, LENS ANTENNA, REMOTE RADIO UNIT, AND BASE STATION

(71) Applicant: HUAWEI TECHNOLOGIES CO., LTD., Guangdong (CN)

(72) Inventors: Xin Luo, Chengdu (CN); Yi Chen, Chengdu (CN); Long Kong, Chengdu (CN)

(73) Assignee: Huawei Technologies Co., Ltd., Guangdong (CN)

( * ) Notice: Subject to any disclaimer, the term of this patent is extended or adjusted under 35 U.S.C. 154(b) by 77 days.

(21) Appl. No.: 16/986,809

(22) Filed: Aug. 6, 2020

(65) Prior Publication Data

US 2020/0365997 A1 Nov. 19, 2020

Related U.S. Application Data

(63) Continuation of application No. PCT/CN2018/075402, filed on Feb. 6, 2018.

(51) Int. Cl.
*H01Q 15/08* (2006.01)
*H01Q 1/24* (2006.01)
(Continued)

(52) U.S. Cl.
CPC ..... *H01Q 15/08* (2013.01); *H01Q 1/42* (2013.01); *H01Q 7/00* (2013.01); *H01Q 19/06* (2013.01);
(Continued)

(58) Field of Classification Search
CPC ..... H01Q 15/08; H01Q 7/00; H01Q 21/225; H01Q 1/246; H01Q 15/006; H01Q 15/0086; H01Q 19/062; H01Q 19/06; H01Q 1/42
See application file for complete search history.

(56) References Cited

U.S. PATENT DOCUMENTS 6,885,355 B2 * 4/2005 Killen ..... H01Q 15/02 343/700 MS
8,743,000 B2 * 6/2014 Gagnon ..... H01Q 15/0006 343/753
(Continued)

FOREIGN PATENT DOCUMENTS

CN 1856907 A 11/2006
CN 102480002 A 5/2012
(Continued)

OTHER PUBLICATIONS

Extended European Search Report issued in European Application No. 18904710.3 dated Dec. 1, 2020. 7 pages.
(Continued)

*Primary Examiner* — Vibol Tan
(74) *Attorney, Agent, or Firm* — Fish & Richardson P.C.

(57) ABSTRACT

This application provides implementations related to lenses. In one implementation, a lens comprises a substrate layer and a metal layer, wherein at least one surface of the substrate layer is a concave surface or a convex surface; the metal layer exists on the at least one surface of the substrate layer; the metal layer comprises a metal part and a hollow-out part, and the metal part or the hollow-out part is presented by using a graphics array; the graphics array comprises a plurality of first rings, the first ring comprises a plurality of graphic units, and a larger ring encircles a smaller ring in the plurality of first rings; and at least one of the following are different: size of graphic units comprised in two adjacent first rings, rotation angle of graphic units comprised in two adjacent first rings, or two adjacent first intervals, wherein the first interval is an interval between the two adjacent first rings.

19 Claims, 7 Drawing Sheets

(51) Int. Cl.

| | |
|---|---|
| ***H01Q 19/06*** | (2006.01) |
| ***H01Q 7/00*** | (2006.01) |
| ***H01Q 21/22*** | (2006.01) |
| ***H01Q 1/42*** | (2006.01) |

(52) U.S. Cl.
CPC ..... *H01Q 19/062* (2013.01); *H01Q 21/225* (2013.01); *H01Q 1/246* (2013.01)

(56) References Cited

U.S. PATENT DOCUMENTS

| | | | | |
|---|---|---|---|---|
| 10,887,004 | B2 * | 1/2021 | Tugend | H04B 7/18515 |
| 10,931,364 | B2 * | 2/2021 | Thain | H04B 7/18513 |
| 11,177,577 | B2 * | 11/2021 | Yemelong | H01Q 3/46 |
| 2004/0008145 | A1 | 1/2004 | Killen et al. | |
| 2005/0212989 | A1 | 9/2005 | Kashiwagi et al. | |
| 2006/0132379 | A1 | 6/2006 | Peterson | |

FOREIGN PATENT DOCUMENTS

| | | | | |
|---|---|---|---|---|
| CN | 102593611 | A | 7/2012 | |
| CN | 103036040 | A | 4/2013 | |
| CN | 103390801 | A | 11/2013 | |
| CN | 204303994 | U | 4/2015 | |
| CN | 107579353 | A | 1/2018 | |
| EP | 2360785 | A1 | 8/2011 | |
| EP | 2738874 | A1 | 6/2014 | |
| JP | H0786827 | A | 3/1995 | |
| WO | WO-2005034291 | A1 * | 4/2005 | H01Q 15/08 |
| WO | 2013013465 | A1 | 1/2013 | |

OTHER PUBLICATIONS

PCT International Search Report and Written Opinion in International Application No. PCT/CN2018/075,402, dated Sep. 27, 2018, 13 pages (With English Translation).

Office Action issued in Chinese Application No. 201880087888.3 dated Dec. 24, 2020, 13 pages.

Office Action in Indian Application No. 202027032994, dated May 20, 2021, 5 pages.

* cited by examiner

Center connection graphics

Ring-shaped graphics

Filled graphics or planar graphics

Top view

LENS, LENS ANTENNA, REMOTE RADIO UNIT, AND BASE STATION

CROSS-REFERENCE TO RELATED APPLICATIONS

This application is a continuation of International Patent Application No. PCT/CN2018/075402, filed on Feb. 6, 2018, the disclosure of which is hereby incorporated by reference in its entirety.

TECHNICAL FIELD

This application relates to the microwave communications field, and more specifically, to a lens, a lens antenna, a remote radio unit RRU, and a base station.

BACKGROUND

Point to multipoint microwave communications devices are required in application scenarios such as a wireless fixed access scenario, a base station backhaul scenario of dense deployment of base stations in urban, a safe city scenario, and an enterprise network scenario. Different from a conventional point to point device antenna that pursues a high gain, an antenna of a central node of a point to multipoint device needs to cover a relatively large angle in a horizontal plane, and also needs to have a relatively high gain and a relatively low side lobe level. Therefore, the antenna of the central node needs to support a beam sweeping function or a multi-beam function.

A dielectric lens antenna is a common form for implementing beam sweeping or multi-beam. However, a low-band high-gain dielectric lens antenna usually requires a relatively large aperture size, and a thickness of a dielectric lens is directly proportional to a diameter of the dielectric lens. Consequently, the low-band dielectric lens antenna is usually relatively thick and very heavy, is difficult to mount and use, has a high dielectric loss, and has very low radiation efficiency.

Therefore, how to reduce the thickness of the dielectric lens becomes a problem that needs to be urgently resolved.

SUMMARY

This application provides a lens, a lens antenna, a radio remote unit (Radio Remote Unit, RRU), and a base station, to reduce a thickness of the lens.

According to a first aspect, a lens is provided. The lens includes a substrate layer and a metal layer, where at least one surface of the substrate layer is a concave surface or a convex surface; the metal layer exists on the at least one surface of the substrate layer; the metal layer includes a metal part and a hollow-out part, and the metal part or the hollow-out part is presented by using a graphics array; the graphics array includes a plurality of first rings, the first ring includes a plurality of graphic units, and a larger ring encircles a smaller ring in the plurality of first rings; and graphic units included in two adjacent first rings are different in at least one of size and rotation angle, and/or two adjacent first intervals are different, where the first interval is an interval between the two adjacent first rings.

In the foregoing technical solution, the metal layer exists on the substrate layer, and the metal layer includes the metal part and the hollow-out part. When an electromagnetic wave passes through the metal layer, the metal part in the metal layer is equivalent to an inductance element, and the hollow-out part is equivalent to a capacitance element, so that a resonant circuit can be formed, and a phase shift is generated by the transmitted electromagnetic wave. A resonant circuit corresponding to each location may be changed by changing at least one of the sizes and the rotation angles of the graphic units included in the two adjacent first rings, and the interval between the two adjacent first rings, so that a phase shift amount generated by the transmitted electromagnetic wave is changed. In this way, the transmitted electromagnetic wave generates different phase shift amounts at different locations on the substrate layer, and the generated different phase shift amounts are used to compensate for phase differences of the electromagnetic wave that are caused by distance differences. Therefore, a phase shift amount generated by changing a thickness of the substrate layer can be reduced, thereby reducing the thickness of the substrate layer, and further reducing a thickness of the lens.

In a possible implementation, graphic units included in a same first ring have a same size and a same rotation angle.

In the foregoing technical solution, the plurality of graphic units included in the same first ring have the same size and the same rotation angle, so that mutual impact between phase shifts generated by the electromagnetic wave at a location of the same ring can be avoided, and lens design difficulty can be reduced.

In a possible implementation, a first parameter gradually increases from a first value to a second value from an edge of the lens to a center of the lens; and the first parameter includes at least one of the following parameters: sizes of the graphic units included in the first ring, rotation angles of the graphic units included in the first ring, and the first interval.

In the foregoing technical solution, at least one of the sizes and the rotation angles of the graphic units included in the first ring, and the interval between the two adjacent first rings changes between the center of the lens and the edge of the lens, so that the transmitted electromagnetic wave can generate the different phase shift amounts at the different locations on the substrate layer by changing the metal layer, and the generated phase shift amounts are used to compensate for the phase differences of the electromagnetic wave that are caused by the distance differences. Therefore, the phase shift amount generated by changing the thickness of the substrate layer can be reduced, thereby reducing the thickness of the substrate layer, and further reducing the thickness of the lens.

In a possible implementation, a first parameter of the graphic unit periodically changes, and the first parameter of the graphic unit gradually increases from a first value to a second value in each change periodicity; and the first parameter includes at least one of the following parameters: sizes of the graphic units included in the first ring, rotation angles of the graphic unit included in the first ring, and the first interval.

When an antenna diameter is relatively large, a phase difference that needs to be compensated for at some locations on an antenna aperture may exceed 360°. Based on a periodic characteristic of the transmitted electromagnetic wave, a remaining degree obtained by subtracting an integer multiple of 360° may be compensated for. Therefore, the first parameter of the graphic unit periodically changes from the edge of the lens to the center of the lens, and the first parameter gradually increases from the first value to the second value in each change periodicity, to compensate for the remaining degree obtained by subtracting the integer multiple of 360°, so that the thickness of the substrate layer can further be reduced, and the overall thickness of the lens and a used dielectric material can further be reduced.

In a possible implementation, the graphics array further includes a plurality of second rings, the second ring includes a plurality of graphic units, and a larger ring encircles a smaller ring in the plurality of second rings and the plurality of first rings; graphic units included in two adjacent second rings have a same size and a same rotation angle, and two adjacent second intervals are the same, where the second interval is an interval between the two adjacent second rings; at a location corresponding to an area in which the plurality of first rings are located, the thickness of the substrate layer remains unchanged; and at a location corresponding to an area in which the plurality of second rings are located, the thickness of the substrate layer gradually increases from the edge of the lens to the center of the lens.

In the foregoing technical solution, from the edge of the lens to the center of the lens, when the metal layer is changed, the thickness of the substrate layer remains unchanged, and when the metal layer remains unchanged, the thickness of the substrate layer gradually increases. In this way, the change in the thickness of the substrate layer and the change in the metal layer can be fully used, to make the transmitted electromagnetic wave generate the phase shift, to compensate for the phase difference of the electromagnetic wave that is caused by the distance difference, so that the thickness of the substrate layer can be reduced, and further the thickness of the lens can be reduced.

In a possible implementation, graphic units included in a same second ring have a same size and a same rotation angle.

In the foregoing technical solution, the plurality of graphic units included in the same second ring have the same size and the same rotation angle, so that mutual impact between phase shifts generated by the electromagnetic wave at a location of the same ring can be avoided, and lens design difficulty can be reduced.

In a possible implementation, compared with each first ring, the plurality of second rings are far away from the center of the lens; the first parameter gradually increases from the first value to the second value from the edge of the lens to the center of the lens, and a second parameter is the first value; and the first parameter includes at least one of the following parameters: the sizes of the graphic units included in the first ring, the rotation angles of the graphic units included in the first ring, and the first interval; and the second parameter includes sizes of the plurality of graphic units included in the second ring, rotation angles of the plurality of graphic units included in the second ring, and the second interval.

In the foregoing technical solution, the phase difference is compensated for first by changing the thickness of the substrate layer, until a remaining phase difference can be compensated for by depending only on the metal layer. In this way, not only the change in the thickness of the substrate layer is fully used, but also the change in the metal layer is fully used, so that the thickness of the substrate layer can be properly reduced, and the thickness of the lens can further be reduced.

In a possible implementation, compared with each first ring, the plurality of second rings are far away from the edge of the lens; the first parameter gradually increases from the first value to the second value from the edge of the lens to the center of the lens, and a second parameter is the second value; and the first parameter includes at least one of the following parameters: the sizes of the graphic units included in the first ring, the rotation angles of the graphic units included in the first ring, and the first interval; and the second parameter includes sizes of the plurality of graphic units included in the second ring, rotation angles of the plurality of graphic units included in the second ring, and the second interval.

In the foregoing technical solution, keeping the second value at the center of the lens means that the second parameter is a maximum value in an area in which the metal layer is not changed. On such a basis, the thickness of the substrate layer is changed to compensate for a remaining phase difference. In this way, the phase difference can be compensated for by depending on the metal layer as much as possible near the center of the lens, so that the phase difference compensated for by changing the thickness of the substrate layer can be reduced, thereby reducing the thickness of the substrate layer, and further reducing the thickness of the lens.

In a possible implementation, the graphic unit is a center connection graphic, a ring-shaped graphic, or a filled graphic.

In a possible implementation, a sum of lengths of arms connected to a central point of the center connection graphic is 0.5 time to twice a wavelength of the transmitted electromagnetic wave; an outer circumference of the ring-shaped graphic is 0.5 time to twice the wavelength of the transmitted electromagnetic wave; and a circumference of the filled graphic is 0.5 time to twice the wavelength of the transmitted electromagnetic wave.

In a possible implementation, the center connection graphic includes two long arms and four short arms; and the two long arms are cross-connected, each end of the long arm is connected to a central location of one short arm, the two long arms and the four short arms are located on a same plane, and the long arm is perpendicular to the connected short arm.

In a possible implementation, lengths of short arms of center connection graphics included in the two adjacent first rings are different.

In a possible implementation, the ring-shaped graphic is an open resonant ring.

In a possible implementation, outer circumferences of ring-shaped graphics included in the two adjacent first rings are different.

In a possible implementation, circumferences of filled graphics included in the two adjacent first rings are different.

In a possible implementation, the substrate layer is made of a dielectric material, and the dielectric material includes resin, glass, or ceramic.

In a possible implementation, the convex surface or the concave surface of the substrate layer is a stepped surface.

According to a second aspect, a lens antenna is provided. The lens antenna includes: the lens according to any one of the first aspect or the possible implementations of the first aspect; and a feed, configured to radiate an electromagnetic wave to the lens, where the feed is disposed on a focal plane of the lens.

According to a third aspect, a remote radio unit RRU is provided. The RRU includes the lens antenna according to the second aspect.

According to a fourth aspect, a base station is provided. The base station includes: a base station transceiver, where the lens antenna according to the second aspect is disposed in the transceiver; and a controller, configured to control the transceiver.

According to a fifth aspect, a lens manufacturing method is provided. The method includes: plating all areas of at least one surface of a substrate layer with a metal layer, where the at least one surface of the substrate layer is a concave surface or a convex surface; and etching the metal layer to form a hollow-out metal layer, where a metal part or a hollow-out part of the metal layer is presented by using a graphics array; the graphics array includes a plurality of first rings, the first ring includes a plurality of graphic units, and a larger ring encircles a smaller ring in the plurality of first rings; and graphic units included in two adjacent first rings are different in at least one of size and rotation angle, and/or two adjacent first intervals are different, where the first interval is an interval between the two adjacent first rings.

In a possible implementation, graphic units included in a same first ring have a same size and a same rotation angle.

In a possible implementation, a first parameter gradually increases from a first value to a second value from an edge of a lens to a center of the lens; and the first parameter includes at least one of the following parameters: sizes of the graphic units included in the first ring, rotation angles of the graphic units included in the first ring, and the first interval.

In a possible implementation, a first parameter periodically changes from an edge of a lens to a center of the lens, and the first parameter gradually increases from a first value to a second value in each change periodicity; and the first parameter includes at least one of the following parameters: sizes of the graphic units included in the first ring, rotation angles of the graphic units included in the first ring, and the first interval.

In a possible implementation, the graphics array further includes a plurality of second rings, the second ring includes a plurality of graphic units, and a larger ring encircles a smaller ring in the plurality of second rings and the plurality of first rings; graphic units included in two adjacent second rings have a same size and a same rotation angle, and two adjacent second intervals are the same, where the second interval is an interval between the two adjacent second rings; at a location corresponding to an area in which the plurality of first rings are located, a thickness of the substrate layer remains unchanged; and at a location corresponding to an area in which the plurality of second rings are located, the thickness of the substrate layer gradually increases from the edge of the lens to the center of the lens.

In a possible implementation, graphic units included in a same second ring have a same size and a same rotation angle.

In a possible implementation, compared with each first ring, the plurality of second rings are far away from the center of the lens; the first parameter gradually increases from the first value to the second value from the edge of the lens to the center of the lens, and a second parameter is the first value; and the first parameter includes at least one of the following parameters: the sizes of the graphic units included in the first ring, the rotation angles of the graphic units included in the first ring, and the first interval; and the second parameter includes sizes of the plurality of graphic units included in the second ring, rotation angles of the plurality of graphic units included in the second ring, and the second interval.

In a possible implementation, compared with each first ring, the plurality of second rings are close to the center of the lens; the first parameter gradually increases from the first value to the second value from the edge of the lens to the center of the lens, and a second parameter is the first value; and the first parameter includes at least one of the following parameters: the sizes of the graphic units included in the first ring, the rotation angles of the graphic units included in the first ring, and the first interval; and the second parameter includes sizes of the plurality of graphic units included in the second ring, rotation angles of the plurality of graphic units included in the second ring, and the second interval.

According to a sixth aspect, a lens manufacturing method is provided. The method includes: activating at least one surface of a substrate layer, where a graphics array is presented in an activated area, the graphics array includes a plurality of first rings, the first ring includes a plurality of graphic units, and a larger ring encircles a smaller ring in the plurality of first rings; and graphic units included in two adjacent first rings are different in at least one of size and rotation angle, and/or two adjacent first intervals are different, where the first interval is an interval between the two adjacent first rings; and plating the activated area with metal to form a hollow-out metal layer.

In a possible implementation, graphic units included in a same first ring have a same size and a same rotation angle.

In a possible implementation, a first parameter gradually increases from a first value to a second value from an edge of a lens to a center of the lens; and the first parameter includes at least one of the following parameters: sizes of the graphic units included in the first ring, rotation angles of the graphic units included in the first ring, and the first interval.

In a possible implementation, a first parameter periodically changes from an edge of a lens to a center of the lens, and the first parameter gradually increases from a first value to a second value in each change periodicity; and the first parameter includes at least one of the following parameters: sizes of the graphic units included in the first ring, rotation angles of the graphic units included in the first ring, and the first interval.

In a possible implementation, the graphics array further includes a plurality of second rings, the second ring includes a plurality of graphic units, and a larger ring encircles a smaller ring in the plurality of second rings and the plurality of first rings; graphic units included in two adjacent second rings have a same size and a same rotation angle, and two adjacent second intervals are the same, where the second interval is an interval between the two adjacent second rings; at a location corresponding to an area in which the plurality of first rings are located, a thickness of the substrate layer remains unchanged; and at a location corresponding to an area in which the plurality of second rings are located, the thickness of the substrate layer gradually increases from the edge of the lens to the center of the lens.

In a possible implementation, graphic units included in a same second ring have a same size and a same rotation angle.

In a possible implementation, compared with each first ring, the plurality of second rings are far away from the center of the lens; the first parameter gradually increases from the first value to the second value from the edge of the lens to the center of the lens, and a second parameter is the first value; and the first parameter includes at least one of the following parameters: the sizes of the graphic units included in the first ring, the rotation angles of the graphic units included in the first ring, and the first interval; and the second parameter includes sizes of the plurality of graphic units included in the second ring, rotation angles of the plurality of graphic units included in the second ring, and the second interval.

In a possible implementation, compared with each first ring, the plurality of second rings are close to the center of the lens; the first parameter gradually increases from the first value to the second value from the edge of the lens to the center of the lens, and a second parameter is the first value; and the first parameter includes at least one of the following parameters: the sizes of the graphic units included in the first ring, the rotation angles of the graphic units included in the first ring, and the first interval; and the second parameter includes sizes of the plurality of graphic units included in the second ring, rotation angles of the plurality of graphic units included in the second ring, and the second interval.

Therefore, in this application, the metal layer with the graphic units is disposed on the substrate layer, and the metal layer is changed by changing at least one of the sizes and the rotation angles of the plurality of graphics units, and/or the interval between the two adjacent rings, so that the transmitted electromagnetic wave generates the different phase shift amounts at the different locations on the substrate layer, and the generated phase shift amounts are used to compensate for the phase differences of the electromagnetic wave that are caused by the distance differences. Therefore, the phase shift amount generated by changing the thickness of the substrate layer can be reduced, thereby reducing the thickness of the substrate layer, and further reducing the thickness of the lens.

DESCRIPTION OF EMBODIMENTS

A lens, a lens antenna, a remote radio unit RRU, and a base station mentioned in embodiments of this application may be applied to a low-frequency wireless communications scenario, or may be applied to any other field in which a thickness of a lens needs to be reduced.

The lens antenna includes a lens and a feed placed on a focus of the lens, so that a spherical wave or a cylindrical wave of the feed can be converted into a plane wave, and therefore a pen-shaped beam, a sector-shaped beam, or a beam in another shape is obtained. The plane wave is a wave whose plane is formed by points with a same vibration phase at a same moment in propagation space of the wave. The feed is a primary radiator, such as a source horn or a dipole, of a continuous-diameter antenna or an antenna array, and radiates radio frequency power from a feeder to the lens or the like in a form of an electromagnetic wave.

Figure 1:
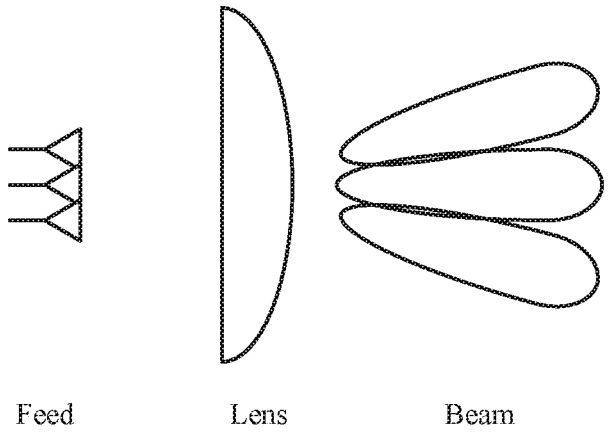
FIG. 1 is a schematic diagram of implementing a multi-beam function by a dielectric lens antenna.

In addition, the lens antenna is a common form for implementing beam sweeping or multi-beam. A beam direction of the lens antenna deflects as the feed horizontally deviates from the focus. Beam sweeping can be implemented by moving the feed on a focal plane, and a multi-beam function can be implemented by placing a plurality of feeds on the focal plane, as shown in FIG. 1.

In the lens antenna, distances from the feed to locations on an antenna aperture are different. Therefore, propagation paths of electromagnetic waves radiated by the feed to the antenna aperture are different. As a result, phases of the electromagnetic waves that arrive at the locations on the antenna aperture are different, causing an antenna aperture phase difference. An excessively large aperture phase difference causes an aperture efficiency decrease, a gain decrease, a side lobe level increase, and even a dent on a main lobe.

Phase velocities and wavelengths of electromagnetic waves in different media are different. Therefore, to avoid the foregoing case, a lens may be designed to adjust a phase velocity of an electromagnetic wave radiated by a feed, so that phase differences caused by distance differences between the feed and different locations on an antenna aperture are compensated for, and a plane wave on the antenna aperture is obtained.

This application provides a lens, a lens antenna, a base station, and a lens manufacturing method. A hollow-out metal layer may be used to make a transmitted electromagnetic wave generate a phase shift amount, to compensate for at least some phase differences of the electromagnetic wave that are caused by distance differences, so that a thickness of the lens can be reduced.

The following describes the technical solutions of this application with reference to the accompanying drawings.

The lens in the embodiments of this application may be mounted on an antenna to form a lens antenna, or may be applied to any other suitable device.

The lens antenna in the embodiments of this application may be mounted on a base station, or may be applied to any other suitable device.

The base station in the embodiments of this application may be a base station in a point to multipoint system (point to multipoint system), a base transceiver station (base transceiver station, BTS) in a global system for mobile communications (global system for mobile communication, GSM) or a code division multiple access (code division multiple access, CDMA) system, a NodeB (nodeB, NB) in a wideband code division multiple access (wideband code division multiple access, WCDMA) system, or an evolved NodeB (evolutional node B, eNB or eNodeB) in a long term evolution (long term evolution, LTE) system. This is not specifically limited in the embodiments of this application.

Figure 2:
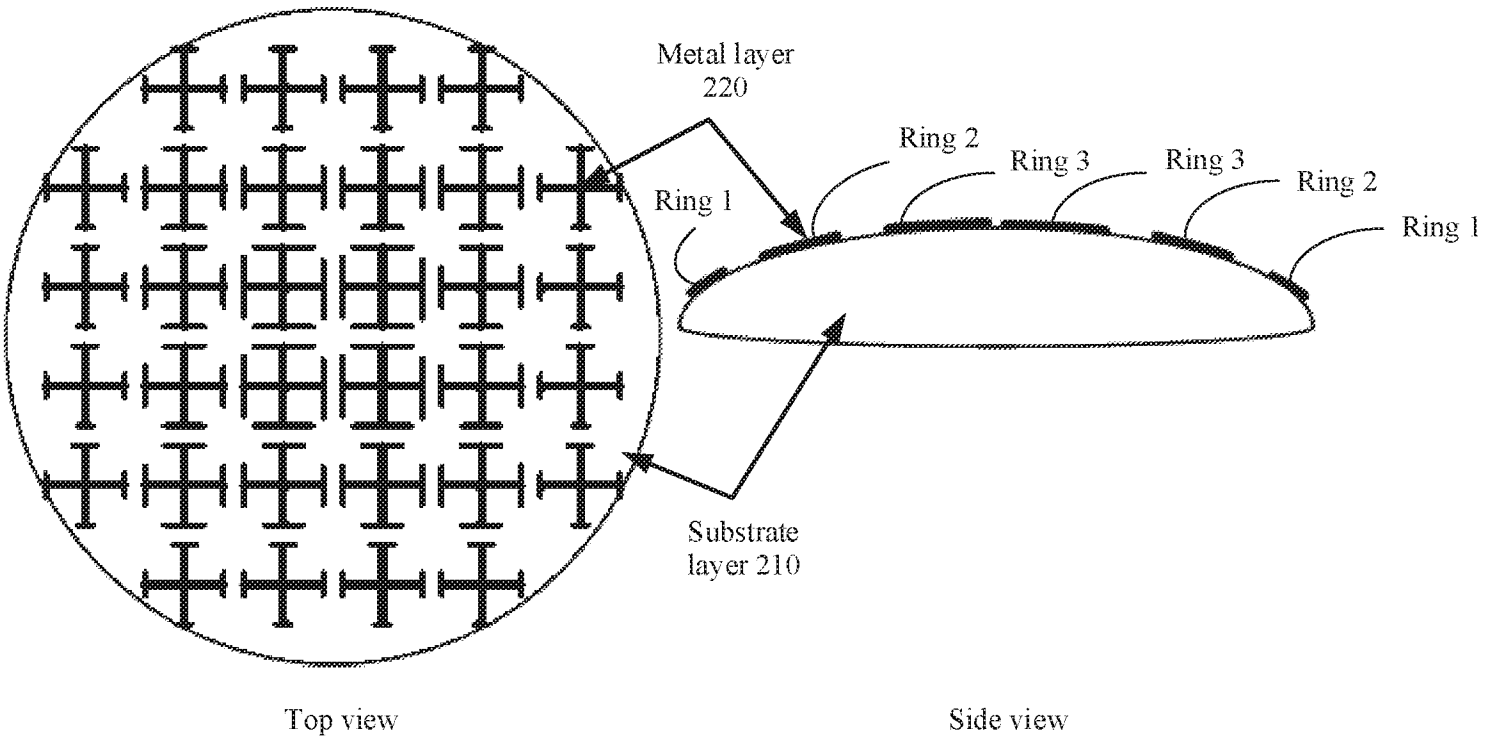
FIG. 2 is a schematic structural diagram of a lens according to an embodiment of this application.
Figure 3:
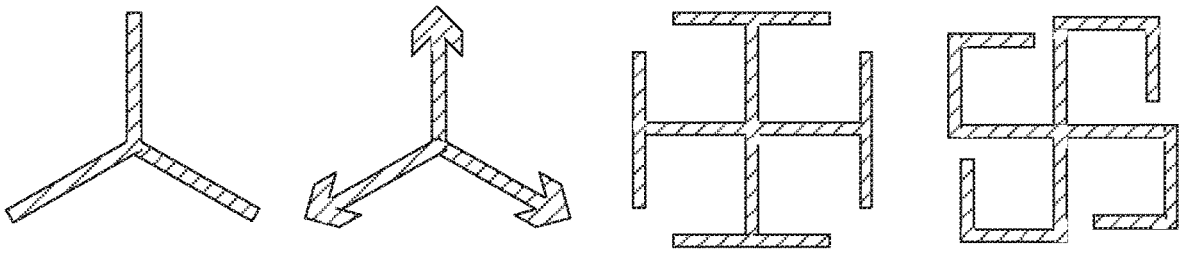
FIG. 3 is a schematic diagram of some center connection graphics according to an embodiment of this application.

FIG. 2 is a schematic structural diagram of a lens according to an embodiment of this application. It should be understood that an example of a lens described in FIG. 3 is merely intended to help a person skilled in the art understand the embodiments of this application, but is not intended to limit the embodiments of this application to a specific form or a specific scenario shown in the example.

As shown in FIG. 2, the lens includes a substrate layer 210 and a metal layer 220. At least one surface of the substrate layer 210 is a concave surface or a convex surface; the metal layer 220 exists on the at least one surface of the substrate layer 210; the metal layer 220 includes a metal part and a hollow-out part, and the metal part or the hollow-out part is presented by using a graphics array; the graphics array includes a plurality of first rings, the first ring includes a plurality of graphic units, and a larger ring encircles a smaller ring in the plurality of first rings; and graphic units included in two adjacent first rings are different in at least one of size and rotation angle, and/or two adjacent first intervals are different, where the first interval is an interval between the two adjacent first rings.

Optionally, a single surface of the substrate layer 210 is a concave surface or a convex surface, or two surfaces of the substrate layer 210 are concave surfaces or convex surfaces.

For example, the substrate layer 210 may be a lenticular lens with two convex surfaces, a planoconvex lens with one plane and one convex surface, a planoconcave lens with one plane and one concave surface, a meniscus lens with one concave surface and one convex surface, or the like. This is not specifically limited in this embodiment of this application.

Optionally, the convex surface or the concave surface of the substrate layer 210 is a stepped surface.

For example, the substrate layer 210 may be a lenticular lens with two smooth curved surfaces, a lenticular lens with one smooth curved surface and one stepped surface, a lenticular lens with two stepped surfaces, a planoconvex lens with one plane and one smooth curved surface, a planoconvex lens with one plane and one stepped surface, a planoconcave lens with one plane and one stepped surface, a planoconcave lens with one plane and one smooth curved surface, a meniscus lens with a smooth curved surface and a stepped surface, a meniscus lens with two smooth curved surfaces, a meniscus lens with two stepped surfaces, or the like. This is not specifically limited in this embodiment of this application.

It should be understood that, if the substrate layer 210 is a smooth curved surface, it means that a thickness of the substrate layer 210 is in a continuous change, while if the substrate layer 210 is a stepped surface, it means that a thickness of the substrate layer 210 is in a stepped change.

Optionally, two surfaces of the substrate layer 210 are planes.

It should be understood that, when a phase shift generated by a transmitted electromagnetic wave by depending only on the metal layer 220 can compensate for phase differences caused by distance differences between all feeds and different locations on a lens antenna, the thickness of the substrate layer 210 may not change. In this case, the two surfaces of the substrate layer 210 may be planes.

Optionally, the substrate layer 210 is made of a dielectric material.

For example, the substrate layer 210 may be made of various non-conductive materials such as resin, glass, or ceramic. This is not specifically limited in this embodiment of this application.

Optionally, the metal layer 220 may be disposed on the single surface or the two surfaces of the substrate layer 210.

For example, when the substrate layer 210 is a lenticular lens, the metal layer 220 may be disposed on each of two convex surfaces, or the metal layer 220 may be disposed on either of the two convex surfaces. When the substrate layer 210 is a planoconvex lens, the metal layer 220 may be separately disposed on a plane or a convex surface, or the metal layer 220 may be disposed on each of the convex surface and the plane. When the substrate layer 210 is a planoconcave lens, the metal layer 220 may be separately disposed on a plane or a concave surface, or the metal layer 220 may be disposed on each of the concave surface and the plane. When the substrate layer 210 is a meniscus lens, the metal layer 220 may be separately disposed on a concave surface or a convex surface, or the metal layer 220 may be disposed on each of the concave surface and the convex surface. When the two surfaces of the substrate layer 210 are planes, the metal layer 220 may be disposed on each of the two planes, or the metal layer 220 may be disposed on either of the two planes. This is not specifically limited in this embodiment of this application.

Optionally, the metal layer 220 may be disposed in an area of the single surface or each of the two surfaces of the substrate layer 210.

For example, the metal layer 220 may be disposed in a central area of the single surface or each of central areas of the two surfaces of the substrate layer 210, and the metal layer 220 is not disposed in an edge area. The central area may be a circular area that is on the substrate layer 210, that is centered at a center of the substrate layer 210, and whose size is less than that of the substrate layer 210. This is not specifically limited in this embodiment of this application.

Optionally, the metal layer 220 includes the hollow-out part and the metal part, so that the graphics array is formed on the metal layer 220.

Optionally, the graphics array may be formed by the metal part of the metal layer 220.

Optionally, the graphics array may be formed by the hollow-out part of the metal layer 220.

Optionally, the metal part or the hollow-out part is presented in an arrangement of a plurality of rings.

Optionally, a larger ring encircles a smaller ring in the plurality of rings. That a larger ring encircles a smaller ring means that the plurality of rings are in an encircled manner, and there is an interval between any two rings. It should be understood that the plurality of rings provided in this application are in an encircled manner shown in FIG. 2. A size of the ring may be various metrics such as a circumference, an area, and a radius of the ring. This is not limited in this application.

For example, as shown in FIG. 2, the graphics array may include three rings, where 16 graphic units in the outermost circle form a ring 1, 12 graphic units in the middle circle form a ring 2, and four graphic units in the innermost circle form a ring 3.

Optionally, centers of the rings are the same.

A shape of the ring is not limited in this embodiment of this application. For example, the ring may be a circular ring, or may be a square ring.

Optionally, the center of each of the rings is a center of the lens.

Optionally, each of the rings includes a plurality of graphic units.

Optionally, each of the rings may include a plurality of metal graphic units.

For example, a part of metal is etched, to make a remaining metal part be presented in a shape of the graphic unit.

Optionally, the graphics array may include a plurality of gaps or holes, and the gap or hole is presented in a form of a specific graphic unit.

For example, a part of metal is etched, to make a formed gap or hole be presented in a shape of the graphic unit.

Optionally, the plurality of graphic units are discrete. This means that the plurality of graphic units do not overlap.

It should be understood that when the graphics array includes the plurality of metal graphic units, the graphic units in the obtained metal layer 220 are discontinuous; or when the graphics array includes the plurality of gaps or holes, the plurality of gaps or holes are discrete, but the gaps or holes in the obtained metal layer 220 are continuous.

A specific shape of the graphic unit is not limited in this embodiment of this application. For example, the graphic unit may be a center connection graphic, a ring-shaped graphic, or a filled graphic shown in FIG. 3 to FIG. 5.

Optionally, as shown in FIG. 3, the center connection graphic has a plurality of parts connected to a center, and there are same angles between any two adjacent parts.

Figure 4:
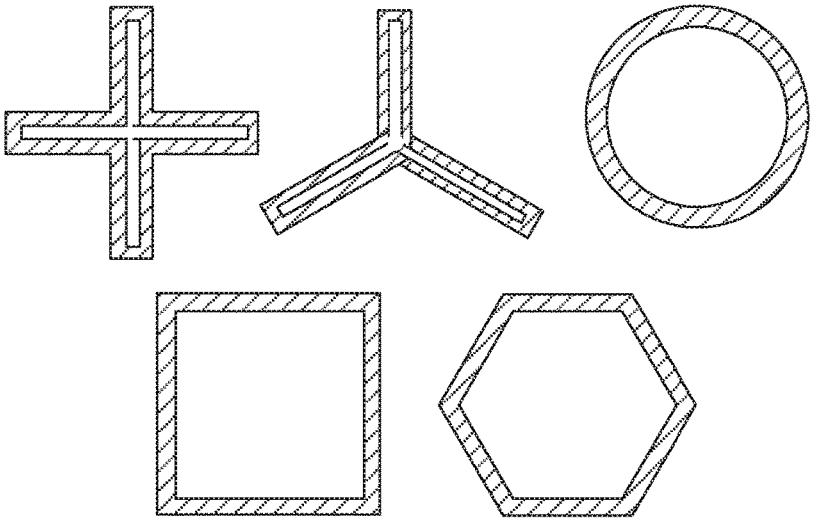
FIG. 4 is a schematic diagram of some ring-shaped graphics according to an embodiment of this application.

Optionally, as shown in FIG. 4, the ring-shaped graphic may be a graphic including a part between a larger graphic and a smaller graphic that are of a same shape and that have a same center.

Figure 5:
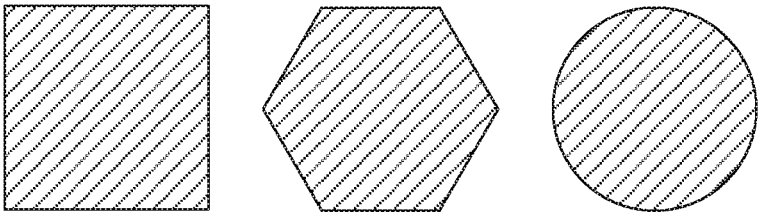
FIG. 5 is a schematic diagram of some filled graphics or planar graphics according to an embodiment of this application.

FIG. 3 to FIG. 5 separately show some center connection graphics, ring-shaped graphics, or filled graphics.

Optionally, the center connection graphic may be a Jerusalem cross ring.

Figure 6:
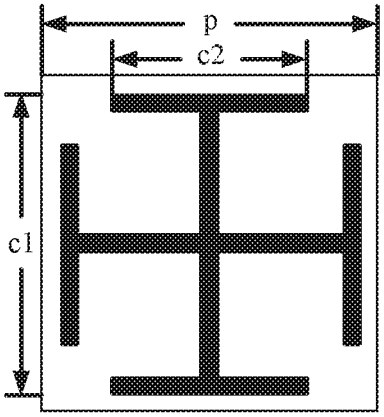
FIG. 6 is a schematic structural diagram of a Jerusalem cross ring according to an embodiment of this application.

FIG. 6 is a schematic structural diagram of a Jerusalem cross ring according to an embodiment of this application. As shown in FIG. 6, the Jerusalem cross ring in this embodiment of this application includes two long arms and four short arms. The two long arms are cross-connected, each end of the long arm is connected to a central location of one short arm, the two long arms and the four short arms are located on a same plane, and the long arm is perpendicular to the short arm connected to the long arm.

c1 represents a length of the long arm of the Jerusalem cross ring, c2 represents a length of the short arm of the Jerusalem cross ring, and p represents an interval between two Jerusalem cross rings (the interval between the two Jerusalem cross rings is an interval between centers of the two Jerusalem cross rings, and p in the figure is an example for description).

Optionally, lengths of the four short arms are the same.

It should be understood that the graphics shown in FIG. 3 to FIG. 6 are merely some examples of the graphic unit in the embodiments of this application, and constitute no limitation on the embodiments of this application. For example, the graphic unit in the embodiments of the present invention may alternatively be star-shaped, triangle ring-shaped, filled triangle-shaped, or the like.

Figure 7:
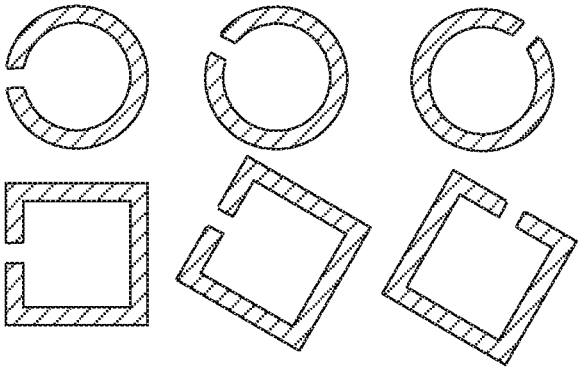
FIG. 7 is a schematic diagram of a relationship between different rotation angles of an open resonant ring and generated phase shift amounts according to an embodiment of this application.

Optionally, the ring-shaped graphic may alternatively be an open resonant ring shown in FIG. 7.

It should be further understood that the graphic unit in the embodiments of the present invention may not be the center connection graphic, the ring-shaped graphic, or the filled graphic, and may be any other graphic that can support the embodiments of the present invention.

In the foregoing technical solution, the graphic unit may be various graphics. Therefore, an appropriate shape of the graphic unit may be selected based on a design requirement on the lens, so that the metal layer can better compensate for the phase difference. This helps reduce the thickness of the substrate layer, and further reduce a thickness of the lens.

Optionally, a sum of lengths of arms connected to a central point of the center connection graphic is 0.5 time to twice a wavelength of the transmitted electromagnetic wave, an outer circumference of the ring-shaped graphic is 0.5 time to twice the wavelength of the transmitted electromagnetic wave, and a circumference of the filled graphic is 0.5 time to twice the wavelength of the transmitted electromagnetic wave.

A basic size of the graphic unit is determined based on the wavelength of the transmitted electromagnetic wave. After the basic size of the graphic unit is determined, it means that a quantity of graphic units that can be placed from the center of the lens to an edge of the lens is basically determined.

Optionally, the plurality of rings include the plurality of first rings. Optionally, the graphic units included in the two adjacent first rings are different in the at least one of size and rotation angle, and/or the two adjacent first intervals are different, where the first interval is an interval between the two adjacent first rings.

Optionally, the graphic units included in the two adjacent first rings are different in size.

Optionally, the size may be an arm length, an outer circumference, a circumference, or any other suitable size.

Optionally, arm lengths of the center connection graphic may be different.

For example, graphic units of adjacent rings in the three rings shown in FIG. 2 are different in size, that is, sums of four short arms of Jerusalem crosses are different.

For example, arm lengths of a plurality of arms connected to centers of the four graphic units shown in FIG. 3 may be different.

For example, lengths of a plurality of short arms connected to endpoints of the plurality of arms of the second to fourth graphic units shown in FIG. 3 may be different.

Optionally, the filled graphics may have different circumferences.

For example, variables of the graphic units shown in FIG. 5 may be circumferences.

Optionally, the ring-shaped graphics may have different outer circumferences.

For example, variables of the graphic units shown in FIG. 4 and FIG. 7 may be outer circumferences.

It should be understood that for different types of graphic units, variable sizes between a plurality of graphic units may be different, and for a same type of graphic units, variable sizes between a plurality of graphic units may also be different.

Optionally, the graphic units included in the two adjacent first rings are different in rotation angle.

Optionally, the rotation angle of the graphic unit may be an angle by which the graphic unit rotates relative to a reference graphic unit.

Optionally, the rotation angle of the graphic unit may be an angle by which the graphic unit rotates relative to a graphic unit included in a ring.

Optionally, the rotation angle of the graphic unit may be an angle by which the graphic unit rotates relative to a particular graphic unit.

For example, if a graphic unit at the center of the lens is selected as a reference graphic, the rotation angle of the graphic unit may be an angle by which the graphic unit rotates relative to the graphic unit at the center of the lens.

For example, the graphic unit is an open resonant ring.

The rotation angle of the graphic unit in this embodiment of this application is described by using an open resonant ring as an example.

FIG. 7 is a schematic diagram of a relationship between different rotation angles of an open resonant ring and generated phase shift amounts according to an embodiment of this application. Using a graphic placement angle of a reference point as a start point, the open resonant ring is rotated clockwise, so that different phase shift amounts may be generated relative to a phase of a transmitted electromagnetic wave at the reference point.

As shown in FIG. 7, it is assumed that a placement angle of the first graphic unit is a reference angle, and it is assumed that in this case, a transmitted electromagnetic wave generates a phase shift amount of 0°. A graphic unit at another location rotates by 45° clockwise relative to the reference angle, and a phase shift amount of 40° may be generated relative to the first graphic unit, that is, a phase difference between the another location of the graphic unit and a location of the first graphic unit is 40°. A graphic unit at another location rotates by 135° clockwise relative to the reference angle, and a phase shift amount of 100° may be generated relative to the first graphic unit, that is, a phase difference between the another location of the graphic unit and the location of the first graphic unit is 100°.

Optionally, the first graphic unit may be placed at a center of a lens, or may be placed at any other location.

It should be understood that the rotation angle and the generated phase shift amount are merely example values used for ease of description, and actual values may be other values. This constitutes no limitation on this embodiment of this application.

Optionally, a relationship between the rotation angle and the generated phase shift amount may be approximately a linear relationship, and a linear coefficient is usually less than 1.

Optionally, the rotation direction may alternatively be counterclockwise.

Optionally, the two adjacent first intervals are different, and the first interval is an interval between the two adjacent first rings.

It should be understood that the first interval is an interval between two first rings. Using a circular ring as an example, the first interval may be a radius difference between two rings.

The two adjacent first intervals mean that there are at least three first rings, for example, a ring A, a ring B, and a ring C. Assuming that the ring B is between the ring A and the ring C, the two adjacent first intervals are an interval between the ring B and the ring A and an interval between the ring B and the ring C. The two adjacent first intervals are different, that is, the interval between the ring B and the ring A and the interval between the ring B and the ring C are different.

Optionally, the interval between the two adjacent first rings may be an interval between the graphic units included in the two first rings from the center of the lens to the edge of the lens.

Figure 8:
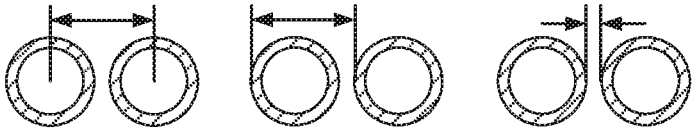
FIG. 8 is a schematic diagram of an interval between graphic units according to an embodiment.

Optionally, as shown in FIG. 8, the interval between the two adjacent first rings may be a distance between central points of the graphic units included in the first ring, or may be a distance between any location on one graphic unit and a same location on another graphic unit, or may be a gap between the plurality of graphic units.

Figure 9:
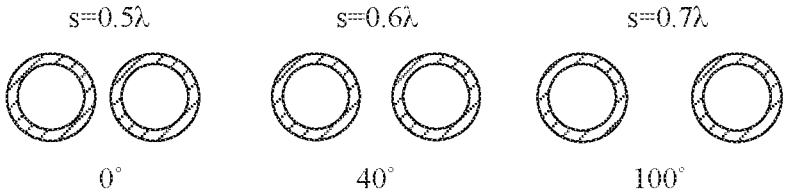
FIG. 9 is a schematic diagram of a relationship between generated phase shift amounts and different intervals between graphic units according to an embodiment of this application.

FIG. 9 is a schematic diagram of a relationship between generated phase shift amounts and different intervals between graphic units according to an embodiment of this application. 0°, 40°, and 100° are phase shift amounts that can be generated by a transmitted electromagnetic wave relative to a case in which an interval between graphic units is 0.5 time the wavelength of the electromagnetic wave when the interval between the graphic units is 0.5 time the wavelength of the electromagnetic wave, when the interval between the graphic units is 0.6 time the wavelength of the electromagnetic wave, and when the distance between the graphic units is 0.7 time the wavelength of the electromagnetic wave.

Optionally, all of the size of the graphic unit, the rotation angle of the graphic unit, and the interval between the rings may be for the reference graphic unit. As the selected reference graphic unit is changed, the size of the graphic unit, the rotation angle of the graphic unit, and the interval between the rings also change.

In the foregoing technical solution, the metal layer exists on the substrate layer, and the metal layer includes the metal part and the hollow-out part. When an electromagnetic wave passes through the metal layer, the metal part in the metal layer is equivalent to an inductance element, and the hollow-out part is equivalent to a capacitance element, so that a resonant circuit can be formed, and a phase shift is generated by the transmitted electromagnetic wave. A resonant circuit corresponding to each location may be changed by changing at least one of the sizes and the rotation angles of the graphic units included in the two adjacent first rings, and the interval between the two adjacent first rings, so that the phase shift generated by the transmitted electromagnetic wave is changed. In this way, the transmitted electromagnetic wave generates different phase shift amounts at different locations on the substrate layer, and the generated different phase shift amounts are used to compensate for phase differences of the electromagnetic wave that are caused by distance differences. Therefore, a phase shift amount generated by changing the thickness of the substrate layer can be reduced, thereby reducing the thickness of the substrate layer, and further reducing the thickness of the lens.

Optionally, the graphic units included in the two adjacent first rings are different in size, or the graphic units included in the two adjacent first rings are different in rotation angle, or the two adjacent first intervals are different, where the first interval is an interval between the two adjacent first rings.

For example, when the graphic units are different in size, the rotation angles of the graphic units remain unchanged, and the first interval remains unchanged; when the graphic units are different in rotation angle, the sizes of the plurality of graphic units remain unchanged, and the first interval remains unchanged; or when the first interval remains unchanged, the sizes and the rotation angles of the graphic units remain unchanged.

In the foregoing technical solution, only a single parameter of the plurality of graphic units is changed, so that the thickness of the substrate layer can be reduced while design difficulty is reduced.

Optionally, graphic units included in a same first ring have a same size and a same rotation angle.

For example, as shown in FIG. 2, in a same ring (for example, the ring 1, the ring 2, or the ring 3), sums of lengths of four short arms of Jerusalem cross rings are the same.

In the foregoing technical solution, the plurality of graphic units included in each first ring have the same size and the same rotation angle, so that mutual impact between phase shifts generated by the electromagnetic wave at a location of the same ring can be avoided, and lens design difficulty can be reduced.

Optionally, a first parameter gradually increases from a first value to a second value from the edge of the lens to the center of the lens, and the first parameter includes at least one of the following parameters: the sizes of the graphic units included in the first ring, the rotation angles of the graphic units included in the first ring, and the first interval.

Optionally, the sizes of the graphic units included in the two adjacent first rings are different, or the rotation angles of the graphic units included in the two adjacent first rings are different, or the two adjacent first intervals are different.

For example, the size of the graphic unit gradually increases from a first size to a second size from the edge of the lens to the center of the lens, or the rotation angle of the graphic unit gradually increases from a first angle to a second angle from the edge of the lens to the center of the lens, or the first interval gradually increases from an interval A to an interval B from the edge of the lens to the center of the lens. This is not specifically limited in this embodiment of this application.

Optionally, at least two of the sizes of the graphic units included in the two adjacent first rings, the rotation angles of the graphic units included in the two adjacent first rings, and the two adjacent first intervals are different.

For example, from the edge of the lens to the center of the lens, the size of the graphic unit gradually increases from a first size to a second size, and the rotation angle of the graphic unit gradually increases from a first angle to a second angle. Alternatively, from the edge of the lens to the center of the lens, the first interval gradually increases from an interval A to an interval B, and the rotation angle of the graphic unit gradually increases from a first angle to a second angle. This is not specifically limited in this embodiment of this application.

Figure 10:
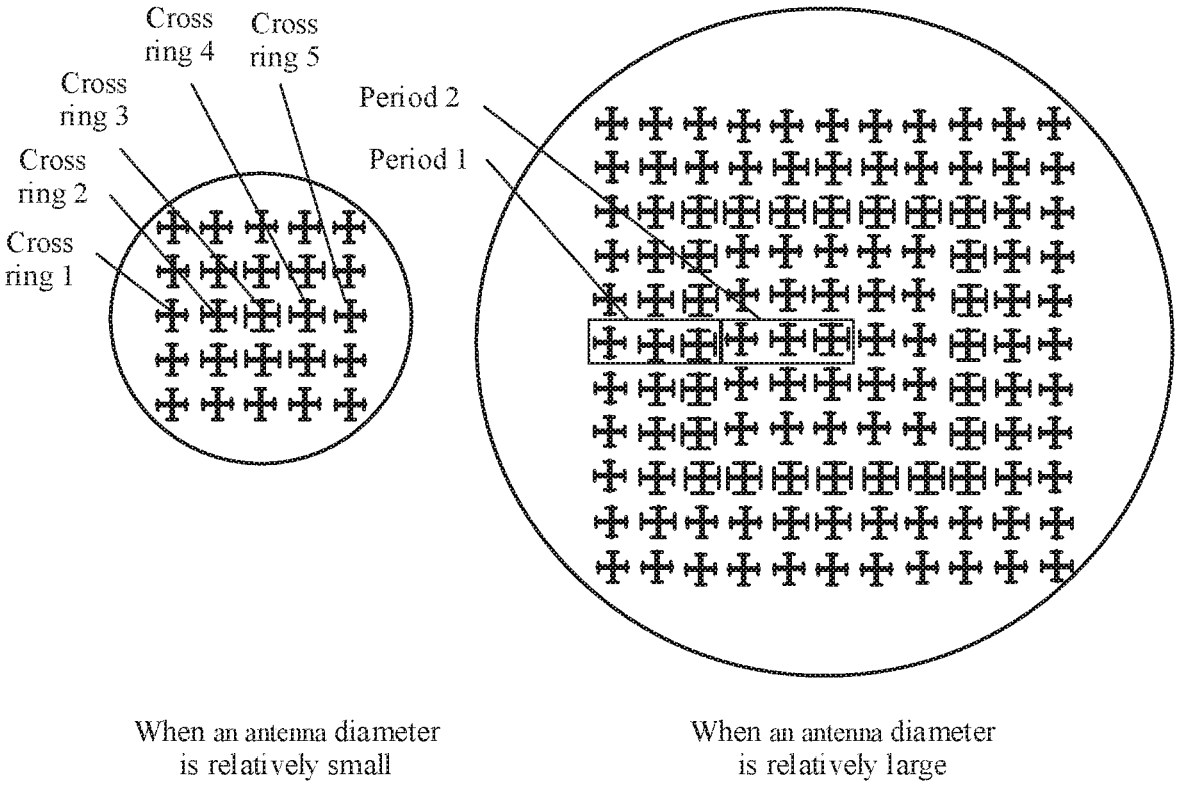
FIG. 10 is a schematic diagram in which a first parameter periodically changes according to an embodiment of this application.

For example, as shown in the left figure in FIG. 10, an example in which the graphic units are Jerusalem cross rings is used for description. A sum of lengths of four short arms of a Jerusalem cross ring 1<a sum of lengths of four short arms of a Jerusalem cross ring 2<a sum of lengths of four short arms of a Jerusalem cross ring 3, and a sum of lengths of four short arms of a Jerusalem cross ring 5<a sum of lengths of four short arms of a Jerusalem cross ring 4<a sum of lengths of four short arms of a Jerusalem cross ring 3. It should be understood that, the first parameter gradually increases from the first value to the second value from the edge of the lens to the center of the lens means that the first parameter gradually decreases from the second value to the first value from the center of the lens to the edge of the lens.

It should be understood that, a rule in which the first parameter gradually increases from the first value to the second value is presented from the edge of the lens to the center of the lens, but this does not mean that the lens is designed or manufactured from the edge to the center. For example, the lens may be designed or manufactured from the center to the edge, or may be designed or manufactured from any location on the lens separately to the center and the edge of the lens.

Optionally, when the first parameter gradually changes, the thickness of the substrate layer 210 may remain unchanged.

For example, when an antenna diameter is relatively small, and a phase shift generated by the transmitted electromagnetic wave by depending only on the metal layer 220 can compensate for phase differences caused by distance differences between all feeds and different locations on a lens antenna, the thickness of the substrate layer 210 may remain unchanged.

Optionally, when the first parameter gradually changes, the thickness of the substrate layer 210 may correspondingly change.

For example, based on an actual requirement, when the first parameter gradually changes, the thickness of the substrate layer 210 may correspondingly change, and the first parameter and the thickness of the substrate layer 210 separately compensate, in an appropriate ratio, for phase differences of some electromagnetic waves that are caused by distance differences, so that the transmitted electromagnetic waves are converted into plane waves.

It should be understood that, a manner in which when the first parameter gradually changes, the thickness of the substrate layer 210 also changes may not only be applied to a case in which an antenna diameter is relatively large (where a phase shift generated by a transmitted electromagnetic wave by depending only on the metal layer 220 cannot completely compensate for a phase difference of the transmitted electromagnetic wave that is caused by a distance difference), but also be applied to a case in which an antenna diameter is relatively small. This is not specifically limited in this embodiment of this application.

Optionally, the first value and the second value may be a minimum value and a maximum value allowed in an ideal condition.

For example, in an ideal condition, the first value of the rotation angle may be 0° and the second value of the rotation angle may be 180° or −180°.

Optionally, the first value and the second value may be any values in an actual condition, and the second value is greater than the first value.

For example, the first value of the rotation angle may be actually 0°, and the second value of the rotation angle may be actually 100°.

Optionally, the first parameter at each location is determined based on a phase difference that needs to be compensated for at each location on the antenna aperture, so that the first parameter gradually increases from the first value to the second value.

In the foregoing technical solution, at least one of the sizes and the rotation angles of the graphic units included in the first ring, and the interval between the two adjacent first rings changes between the center of the lens and the edge of the lens, so that a transmitted electromagnetic wave can generate different phase shift amounts at different locations on the substrate layer by changing the metal layer, and the generated phase shift amounts are used to compensate for phase differences of the electromagnetic wave that are caused by distance differences. Therefore, a phase shift amount generated by changing the thickness of the substrate layer can be reduced, thereby reducing the thickness of the substrate layer, and further reducing the thickness of the lens.

Optionally, a first parameter of the graphic unit periodically changes, and the first parameter of the graphic unit gradually increases from a first value to a second value in each change periodicity; and the first parameter includes at least one of the following parameters: the sizes of the graphic units included in the first ring, the rotation angles of the graphic units included in the first ring, and the first interval.

Optionally, the sizes of the graphic units included in the two adjacent first rings are different, or the rotation angles of the graphic units included in the two adjacent first rings are different, or the two adjacent first intervals are different.

For example, the size of the graphic unit periodically changes from the edge of the lens to the center of the lens, and the size of the graphic unit gradually increases from a first size to a second size in each change periodicity; or the rotation angle of the graphic unit periodically changes from the edge of the lens to the center of the lens, and the rotation angle of the graphic unit gradually increases from a first angle to a second angle in each change periodicity; or the first interval periodically changes from the edge of the lens to the center of the lens, and the first interval gradually increases from a first interval to a second interval in each change periodicity. This is not specifically limited in this embodiment of this application.

Optionally, at least two of the sizes of the graphic units included in the two adjacent first rings, the rotation angles of the graphic units included in the two adjacent first rings, and the two adjacent first intervals are different.

For example, from the edge of the lens to the center of the lens, the size of the graphic unit periodically changes, and the size of the graphic unit gradually increases from a first size to a second size in each change periodicity; in addition, the rotation angle of the graphic unit periodically changes, and the rotation angle of the graphic unit gradually increases from a first angle to a second angle in each change periodicity; or from the edge of the lens to the center of the lens, the first interval periodically changes, and the first interval gradually increases from an interval A to an interval B in each change periodicity; in addition, the rotation angle of the graphic unit periodically changes, and the rotation angle of the graphic unit gradually increases from a first angle to a second angle in each change periodicity. This is not specifically limited in this embodiment of this application.

When an antenna diameter is relatively large, a phase difference that needs to be compensated for at some locations on an antenna aperture may exceed 360°. In this case, there are two options for the phase difference that needs to be compensated for: One is that a phase difference greater than 360° needs to be compensated for, and the other one is that a remaining degree obtained after an integer multiple of 360° is subtracted needs to be compensated for.

For example, when a phase difference that needs to be compensated for at some locations is 400°, 400° may be selected for compensation. In this case, the substrate layer 210 may be relatively thick. Alternatively, 40° may be selected for compensation.

For example, when a phase difference that needs to be compensated for at some locations is 730°, 730° may be selected for compensation. In this case, the substrate layer 210 is very thick. Alternatively, 10° may be selected for compensation.

Based on the foregoing principle, as shown in the right figure in FIG. 10, an example in which the graphic units are Jerusalem cross rings is used for description. From the edge of the lens to the center of the lens (the third Jerusalem cross ring counted from the left in a periodicity 2 is the center of the lens), a periodicity 1 and the periodicity 2 each include three Jerusalem cross rings, sums of lengths of four short arms of the Jerusalem cross rings sequentially increase in each of the periodicity 1 and the periodicity 2, the sum of the lengths of the four short arms of the first Jerusalem cross ring counted from the left in the periodicity 1 is equal to the sum of the lengths of the four short arms of the first Jerusalem cross ring counted from the left in the periodicity 2, the sum of the lengths of the four short arms of the second Jerusalem cross ring counted from the left in the periodicity 1 is equal to the sum of the lengths of the four short arms of the second Jerusalem cross ring counted from the left in the periodicity 2, and the sum of the lengths of the four short arms of the third Jerusalem cross ring counted from the left in periodicity 3 is equal to the sum of the lengths of the four short arms of the third Jerusalem cross ring counted from the left in the periodicity 2.

The first parameter periodically changes from the edge of the lens to the center of the lens, and the first parameter gradually increases from the first value to the second value in each change periodicity, so that a remaining degree obtained after an integer multiple of 360° is subtracted is compensated for.

In this way, the thickness of the substrate layer 210 can be further reduced, and the overall thickness of the lens and the used dielectric material can be further reduced.

It should be understood that the first parameter periodically changes from the edge of the lens to the center of the lens, and the first parameter gradually increases from the first value to the second value in each change periodicity. This means that the first parameter periodically changes from the edge of the lens to the center of lens, and the first parameter gradually decreases from the second value to the first value in each change periodicity.

It should be further understood that the example of the lens described in FIG. 10 is merely intended to help a person skilled in the art understand the embodiments of this application, but is not intended to limit the embodiments of this application to the specific form or the specific scenario shown in the example. For example, the ring may alternatively be a circular ring.

Optionally, when the first parameter gradually changes, the thickness of the substrate layer 210 may remain unchanged.

For example, when an antenna diameter is relatively small, and a phase shift generated by the transmitted electromagnetic wave by depending only on the metal layer 220 can compensate for phase differences caused by distance differences between all feeds and different locations on a lens antenna, the thickness of the substrate layer 210 may remain unchanged.

Optionally, when the first parameter gradually changes, the thickness of the substrate layer 210 may correspondingly change.

For example, based on an actual requirement, when the first parameter gradually changes, the thickness of the substrate layer 210 may correspondingly change, and the first parameter and the thickness of the substrate layer 210 separately compensate, in an appropriate ratio, for phase differences of some electromagnetic waves that are caused by distance differences, so that the transmitted electromagnetic waves are converted into plane waves.

It should be understood that, a manner in which when the first parameter gradually changes, the thickness of the substrate layer 210 also changes may not only be applied to a case in which an antenna diameter is relatively large (where a phase shift generated by a transmitted electromagnetic wave by depending only on the metal layer 220 cannot completely compensate for a phase difference of the transmitted electromagnetic wave that is caused by a distance difference), but also be applied to a case in which an antenna diameter is relatively small. This is not specifically limited in this embodiment of this application.

Optionally, the first value and the second value may be a minimum value and a maximum value allowed in an ideal condition.

For example, in an ideal condition, the first value of the rotation angle may be 0°, and the second value of the rotation angle may be 180° or −180°.

Optionally, the first value and the second value may be any values in an actual condition, and the second value is greater than the first value.

For example, the first value of the rotation angle may be actually 0°, and the second value of the rotation angle may be actually 100°.

Optionally, the first parameter at each location is determined based on a phase difference that needs to be compensated for at each location on the antenna aperture, so that the first parameter periodically changes, and the first parameter gradually increases from the first value to the second value in each change periodicity.

In the foregoing technical solution, the first parameter periodically changes between the center of the lens and the edge of the lens, so that a remaining degree obtained after an integer multiple of 360° is subtracted can be compensated for, thereby further reducing the thickness of the substrate layer and further reducing the overall thickness of the lens and the used dielectric material.

Figure 11:
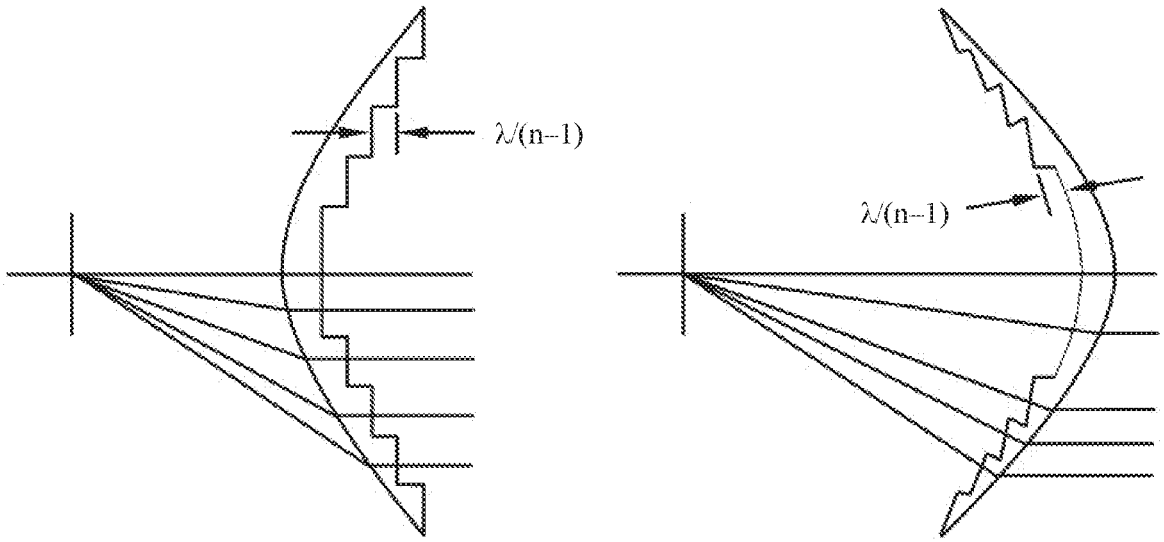
FIG. 11 is a schematic diagram of a method for removing a part of a medium to reduce a thickness of a lens.

There are many methods for compensating for a remaining degree obtained after an integer multiple of 360° is subtracted. For example, as shown in FIG. 11, a medium whose thickness is a wavelength of a transmitted electromagnetic wave at the substrate layer may be removed from one surface of the substrate layer area by area, so that a phase difference at different locations is reduced by an integer multiple of 360°, and a remaining degree is compensated for by changing the first parameter.

In the foregoing technical solution, a part of the medium in the substrate layer is removed without changing a shape of the lens, so that the lens can be further thinned, a dielectric loss is reduced, and radiation efficiency is improved.

In a possible implementation, the graphics array further includes a plurality of second rings, the second ring includes a plurality of graphic units, and a larger ring encircles a smaller ring in the plurality of second rings and the plurality of first rings; graphic units included in two adjacent second rings have a same size and a same rotation angle, and two adjacent second intervals are the same, where the second interval is an interval between the two adjacent second rings; at a location corresponding to an area in which the plurality of first rings are located, the thickness of the substrate layer remains unchanged; and at a location corresponding to an area in which the plurality of second rings are located, the thickness of the substrate layer gradually increases from the edge of the lens to the center of the lens.

Meanings of the size, the rotation angle, and the second interval are similar to the foregoing meanings of the size, the rotation angle, and the first interval. For details, refer to the foregoing descriptions, and details are not described herein again.

In the foregoing technical solution, from the edge of the lens to the center of the lens, when the metal layer is changed, the thickness of the substrate layer remains unchanged, and when the metal layer remains unchanged, the thickness of the substrate layer gradually increases. In this way, the change in the thickness of the substrate layer and the change in the metal layer can be fully used, to make the transmitted electromagnetic wave generate the phase shift, to compensate for the phase difference of the electromagnetic wave that is caused by the distance difference, so that the thickness of the substrate layer can be reduced, and further the thickness of the lens can be reduced.

Optionally, graphic units included in a same second ring have a same size and a same rotation angle.

In the foregoing technical solution, the plurality of graphic units included in the same second ring have the same size and the same rotation angle, so that mutual impact between phase shifts generated by the electromagnetic wave at a location of the same ring can be avoided, and lens design difficulty can be reduced.

Optionally, compared with each first ring, the plurality of second rings are far away from the center of the lens; the first parameter gradually increases from the first value to the second value from the edge of the lens to the center of the lens, and a second parameter is the first value; and the first parameter includes at least one of the following parameters: the sizes of the graphic units included in the first ring, the rotation angles of the graphic units included in the first ring, and the first interval; and the second parameter includes sizes of the plurality of graphic units included in the second ring, rotation angles of the plurality of graphic units included in the second ring, and the second interval.

Optionally, the sizes of the graphic units included in the two adjacent first rings are different, or the rotation angles of the graphic units included in the two adjacent first rings are different, or the two adjacent first intervals are different.

Optionally, at least two of the sizes of the graphic units included in the two adjacent first rings, the rotation angles of the graphic units included in the two adjacent first rings, and the two adjacent first intervals are different.

Optionally, the first value and the second value may be a minimum value and a maximum value allowed in an ideal condition.

For example, in an ideal condition, the first value of the rotation angle may be 0°, and the second value of the rotation angle may be 180 or −180°.

Optionally, the first value and the second value may be any values in an actual condition, and the second value is greater than the first value.

For example, the first value of the rotation angle may be actually 0°, and the second value of the rotation angle may be actually 100°.

Optionally, the first parameter at each location is determined based on a phase difference that needs to be compensated for at each location on the antenna aperture.

It should be understood that, a manner in which when the first parameter gradually changes, the thickness of the substrate layer 210 also changes may not only be applied to a case in which an antenna diameter is relatively large (where a phase shift generated by a transmitted electromagnetic wave by depending only on the metal layer 220 cannot completely compensate for a phase difference of the transmitted electromagnetic wave that is caused by a distance difference), but also be applied to a case in which an antenna diameter is relatively small. This is not specifically limited in this embodiment of this application.

In the foregoing technical solution, the phase difference is compensated for first by changing the thickness of the substrate layer, until a remaining phase difference can be compensated for by depending only on the metal layer. In this way, not only the change in the thickness of the substrate layer is fully used, but also the change in the metal layer is fully used, so that the thickness of the substrate layer can be properly reduced, and the thickness of the lens can further be reduced.

Optionally, compared with each first ring, the plurality of second rings are far away from the edge of the lens; the first parameter gradually increases from the first value to the second value from the edge of the lens to the center of the lens, and a second parameter is the second value; and the first parameter includes at least one of the following parameters: the sizes of the graphic units included in the first ring, the rotation angles of the graphic units included in the first ring, and the first interval; and the second parameter includes sizes of the plurality of graphic units included in the second ring, rotation angles of the plurality of graphic units included in the second ring, and the second interval.

Optionally, the sizes of the graphic units included in the two adjacent first rings are different, or the rotation angles of the graphic units included in the two adjacent first rings are different, or the two adjacent first intervals are different.

Optionally, at least two of the sizes of the graphic units included in the two adjacent first rings, the rotation angles of the graphic units included in the two adjacent first rings, and the two adjacent first intervals are different.

Optionally, the first value and the second value may be a minimum value and a maximum value allowed in an ideal condition.

For example, in an ideal condition, the first value of the rotation angle may be 0°, and the second value of the rotation angle may be 180° or −180°.

Optionally, the first value and the second value may be any values in an actual condition, and the second value is greater than the first value.

For example, the first value of the rotation angle may be actually 0°, and the second value of the rotation angle may be actually 100°.

Optionally, the first parameter at each location is determined based on a phase difference that needs to be compensated for at each location on the antenna aperture.

It should be understood that, a manner in which when the first parameter gradually changes, the thickness of the substrate layer 210 also changes may not only be applied to a case in which an antenna diameter is relatively large (where a phase shift generated by a transmitted electromagnetic wave by depending only on the metal layer 220 cannot completely compensate for a phase difference of the transmitted electromagnetic wave that is caused by a distance difference), but also be applied to a case in which an antenna diameter is relatively small. This is not specifically limited in this embodiment of this application.

In the foregoing technical solution, keeping the second value at the center of the lens means that the second parameter is a maximum value in an area in which the metal layer is not changed. On such a basis, the thickness of the substrate layer is changed to compensate for a remaining phase difference. In this way, the phase difference can be compensated for by depending on the metal layer as much as possible near the center of the lens, so that the phase difference compensated for by changing the thickness of the substrate layer can be reduced, thereby reducing the thickness of the substrate layer, and further reducing the thickness of the lens.

Figure 12:
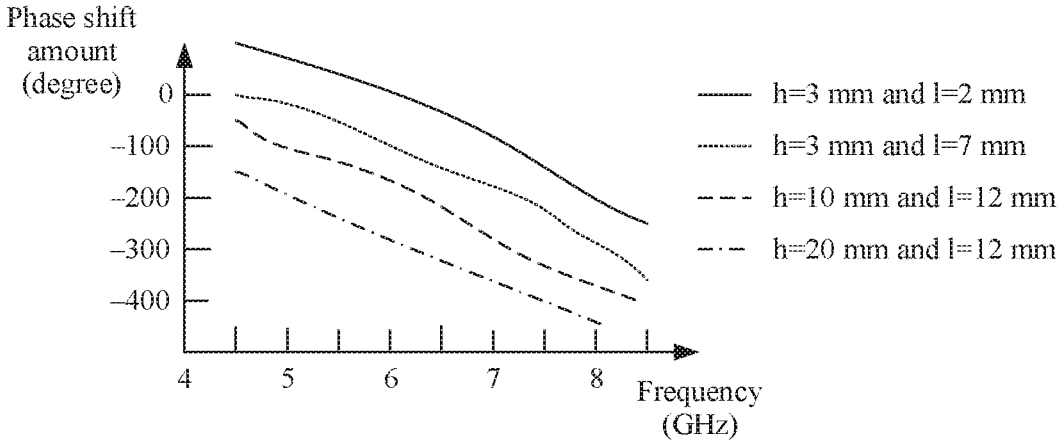
FIG. 12 is a schematic diagram of a relationship between a phase shift amount and a frequency under different substrate layer thicknesses and different short arm lengths.

With reference to FIG. 6 and FIG. 12, the lens in the embodiments of this application is described by using an example in which lengths of short arms of a Jerusalem cross ring are changed. In the embodiments of this application, the substrate layer is made of a medium that is produced by the Rogers Corporation and whose model is RO4003.

Optionally, the lengths of the four short arms of the Jerusalem cross ring in the embodiments of this application may be different.

Optionally, lengths of four long arms are the same.

The two surfaces of the substrate layer are plated with metal graphics: Jerusalem cross rings.

A lens antenna may be designed in the following manner: The thickness of the substrate layer remains unchanged from the edge of the lens to the center of the lens: the lengths of the short arms of the Jerusalem cross ring are increased to increase a phase shift amount generated by a transmitted electromagnetic wave; after the lengths of the short arms are increased to a limit, the thickness of the substrate layer is increased to further increase the phase shift amount generated by the transmitted electromagnetic wave until a central phase difference meets a requirement, so that the graphics array shown in the top view in FIG. 3 is obtained.

The lengths of the short arms of the Jerusalem cross ring are gradually increased from 0 to the length of the long arm, and the length of the long arm can be determined based on a wavelength of the transmitted electromagnetic wave. A sum of lengths of two long arms of the Jerusalem cross ring is 0.5 time to twice the wavelength of the transmitted electromagnetic wave, so that the length of one long arm is between 0.25 time the wavelength of the transmitted electromagnetic wave to the wavelength of the transmitted electromagnetic wave.

When the lengths of the short arms of the Jerusalem cross ring are changed, an interval between the Jerusalem cross rings and rotation angles of the Jerusalem cross rings remain changed.

Optionally, the lens in the embodiments of this application may be thick in the middle, thin in the edge, and in a stepped change.

FIG. 12 is a schematic diagram of a relationship between a phase shift amount and a frequency under different substrate layer thicknesses and different short arm lengths, where a horizontal coordinate is the frequency and a vertical coordinate is the phase shift amount. As shown in FIG. 12, a phase shift amount of the transmitted electromagnetic wave may be changed by changing the lengths of the short arms of the Jerusalem cross ring, and the phase shift amount of the transmitted electromagnetic wave may also be changed by changing the thickness of the substrate layer.

Specifically, when the frequency is 5.8 GHz, a phase difference of 346° may be generated from the thickness of the substrate layer being 3 mm and the length of the short arm being 2 mm to the thickness of the substrate layer being 20 mm and the length of the short arm being 12 mm.

Therefore, feasibility of the technical solution in this embodiment of this application can be verified.

It should be understood that the foregoing design solution is merely an example, and constitutes no limitation on the embodiments of this application.

In addition, an experimental result indicates that, under a same antenna diameter, to make transmitted electromagnetic waves generate a same phase shift amount (or a same phase difference with a reference point), a center thickness of a pure dielectric lens antenna is 90 mm, but in this embodiment of this application, the antenna thickness is reduced by 77%.

In the foregoing technical solution, the lengths of the short arms of the plurality of Jerusalem cross rings change between the center of the lens and the edge of the lens, so that the transmitted electromagnetic wave can generate different phase shift amounts at different locations on the substrate layer by changing the metal layer, and the generated phase shift amounts are used to compensate for phase differences of the electromagnetic wave that are caused by distance differences. Therefore, a phase shift amount generated by changing the thickness of the substrate layer can be reduced, thereby reducing the thickness of the substrate layer.

It should be noted that the examples of the lenses in FIG. 2 to FIG. 12 are merely intended to help a person skilled in the art understand the embodiments of this application, but are not intended to limit the embodiments of this application to the specific values or specific scenarios shown in the examples. A person skilled in the art can apparently make various equivalent modifications or changes according to the examples of the lenses described above, and such modifications or changes also fall within the scope of the embodiments of this application.

An embodiment of this application further provides a lens antenna. The lens antenna includes a feed and the lens described in any one of the foregoing embodiments. The feed is configured to radiate an electromagnetic wave. The feed is disposed on a focal plane of the lens, and is configured to convert the spherical electromagnetic wave into a planar electromagnetic wave. For descriptions related to the lens, refer to the foregoing descriptions, and details are not described herein again.

An embodiment of this application further provides a remote radio unit (remote radio unit, RRU), and the RRU includes the lens antenna described in any one of the foregoing embodiments. For descriptions related to the lens antenna, refer to the foregoing descriptions, and details are not described herein again.

An embodiment of this application further provides a base station. The base station includes a base station transceiver and a base station controller. The lens antenna described in any one of the foregoing embodiments is disposed in the base station transceiver. For descriptions related to the lens antenna, refer to the foregoing descriptions, and details are not described herein again.

The following describes the lens manufacturing method provided in the embodiments of this application.

Figure 13:
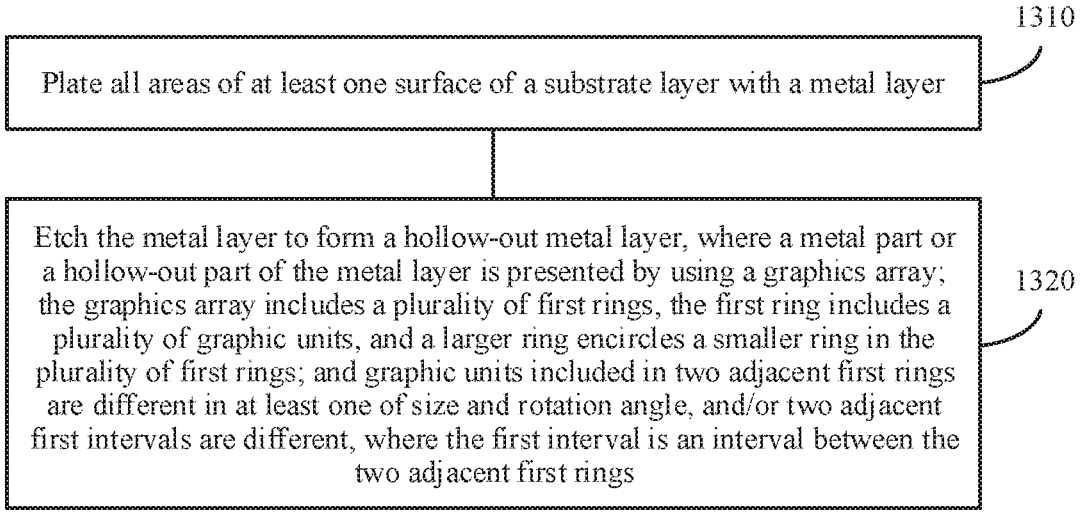
FIG. 13 is a schematic flowchart of a lens manufacturing method according to an embodiment of this application.

FIG. 13 is a schematic flowchart of a lens manufacturing method according to an embodiment of this application. The manufacturing method in FIG. 13 may be used to manufacture the lens in the foregoing embodiments. The manufacturing method in FIG. 13 may include at least a part of content in 1310 to 1320. The following describes 1310 to 1320 in detail.

1310: Plate all areas of at least one surface of a substrate layer with a metal layer, where the at least one surface of the substrate layer is a concave surface or a convex surface.

A plating manner is not specifically limited in this embodiment of this application, and may be any suitable plating manner, for example, electroplating or chemical plating.

1320: Etch the metal layer to form a hollow-out metal layer, where a metal part or a hollow-out part of the metal layer is presented by using a graphics array; the graphics array includes a plurality of first rings, the first ring includes a plurality of graphic units, and a larger ring encircles a smaller ring in the plurality of first rings; and graphic units included in two adjacent first rings are different in at least one of size and rotation angle, and/or two adjacent first intervals are different, where the first interval is an interval between the two adjacent first rings.

An etching manner is not specifically limited in this embodiment of this application, and may be any suitable etching manner, for example, a chemical reaction or a physical collision.

Optionally, graphic units included in a same first ring have a same size and a same rotation angle.

Optionally, a first parameter gradually increases from a first value to a second value from an edge of the lens to a center of the lens; and the first parameter includes at least one of the following parameters: sizes of the graphic units included in the first ring, rotation angles of the graphic units included in the first ring, and the first interval.

Optionally, a first parameter periodically changes from an edge of the lens to a center of the lens, and the first parameter gradually increases from a first value to a second value in each change periodicity; and the first parameter includes at least one of the following parameters: sizes of the graphic units included in the first ring, rotation angles of the graphic units included in the first ring, and the first interval.

Optionally, the graphics array further includes a plurality of second rings, the second ring includes a plurality of graphic units, and a larger ring encircles a smaller ring in the plurality of second rings and the plurality of first rings; graphic units included in two adjacent second rings have a same size and a same rotation angle, and two adjacent second intervals are the same, where the second interval is an interval between the two adjacent second rings; at a location corresponding to an area in which the plurality of first rings are located, a thickness of the substrate layer remains unchanged; and at a location corresponding to an area in which the plurality of second rings are located, the thickness of the substrate layer gradually increases from the edge of the lens to the center of the lens.

Optionally, graphic units included in a same second ring have a same size and a same rotation angle.

Optionally, compared with each first ring, the plurality of second rings are far away from the center of the lens; the first parameter gradually increases from the first value to the second value from the edge of the lens to the center of the lens, and a second parameter is the first value; and the first parameter includes at least one of the following parameters: the sizes of the graphic units included in the first ring, the rotation angles of the graphic units included in the first ring, and the first interval and the second parameter includes sizes of the plurality of graphic units included in the second ring, rotation angles of the plurality of graphic units included in the second ring, and the second interval.

Optionally, compared with each first ring, the plurality of second rings are close to the center of the lens; the first parameter gradually increases from the first value to the second value from the edge of the lens to the center of the lens, and a second parameter is the first value; and the first parameter includes at least one of the following parameters: the sizes of the graphic units included in the first ring, the rotation angles of the graphic units included in the first ring, and the first interval; and the second parameter includes sizes of the plurality of graphic units included in the second ring, rotation angles of the plurality of graphic units included in the second ring, and the second interval.

Optionally, the graphic unit is a center connection graphic, a ring-shaped graphic, or a filled graphic.

Optionally, a sum of lengths of arms connected to a central point of the center connection graphic is 0.5 time to twice a wavelength of a transmitted electromagnetic wave; an outer circumference of the ring-shaped graphic is 0.5 time to twice the wavelength of the transmitted electromagnetic wave; and a circumference of the filled graphic is 0.5 time to twice the wavelength of the transmitted electromagnetic wave.

Optionally, the substrate layer is made of a dielectric material, and the dielectric material includes resin, glass, or ceramic.

Optionally, the convex surface or the concave surface of the substrate layer is a stepped surface.

In this embodiment of this application, a conventional device and a conventional manufacturing process may be used for lens manufacturing, and no additional system loss is caused.

Figure 14:
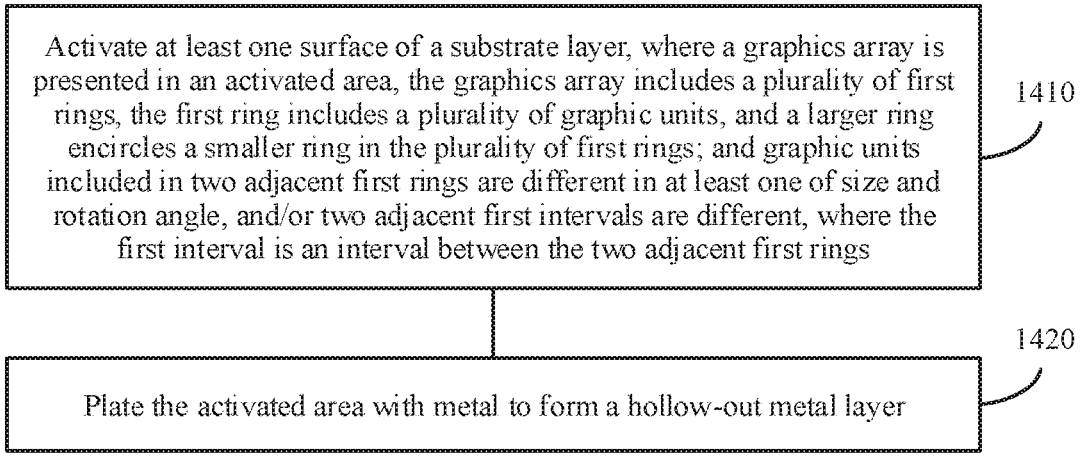
FIG. 14 is a schematic flowchart of another lens manufacturing method according to an embodiment of this application.

FIG. 14 is a schematic flowchart of a lens manufacturing method according to another embodiment of this application. The manufacturing method in FIG. 14 may be used to manufacture the lens in the foregoing embodiments. The manufacturing method in FIG. 14 may include at least a part of content in 1410 to 1420. The following describes 1410 to 1420 in detail.

1410: Activate at least one surface of a substrate layer, where a graphics array is presented in an activated area, the graphics array includes a plurality of first rings, the first ring includes a plurality of graphic units, and a larger ring encircles a smaller ring in the plurality of first rings; and graphic units included in two adjacent first rings are different in at least one of size and rotation angle, and/or two adjacent first intervals are different, where the first interval is an interval between the two adjacent first rings.

The activation manner is not specifically limited in this embodiment of this application, and may be any suitable activation manner, for example, chemical oxidation, flame oxidation, solvent vapor immersion, or corona discharge oxidation.

1420: Plate the activated area with metal to form a hollow-out metal layer.

Optionally, the plating the activated area with metal may be plating the activated area with a metal sheet having shapes of graphic units, or may be coating the metal on the activated area.

An etching manner is not specifically limited in this embodiment of this application, and may be any suitable etching manner, for example, a chemical reaction or a physical collision.

Optionally, graphic units included in a same first ring have a same size and a same rotation angle.

Optionally, a first parameter gradually increases from a first value to a second value from an edge of the lens to a center of the lens; and the first parameter includes at least one of the following parameters: sizes of the graphic units included in the first ring, rotation angles of the graphic units included in the first ring, and the first interval.

Optionally, a first parameter periodically changes from an edge of the lens to a center of the lens, and the first parameter gradually increases from a first value to a second value in each change periodicity; and the first parameter includes at least one of the following parameters: sizes of the graphic units included in the first ring, rotation angles of the graphic units included in the first ring, and the first interval.

Optionally, the graphics array further includes a plurality of second rings, the second ring includes a plurality of graphic units, and a larger ring encircles a smaller ring in the plurality of second rings and the plurality of first rings; graphic units included in two adjacent second rings have a same size and a same rotation angle, and two adjacent second intervals are the same, where the second interval is an interval between the two adjacent second rings; at a location corresponding to an area in which the plurality of first rings are located, a thickness of the substrate layer remains unchanged; and at a location corresponding to an area in which the plurality of second rings are located, the thickness of the substrate layer gradually increases from the edge of the lens to the center of the lens.

Optionally, graphic units included in a same second ring have a same size and a same rotation angle.

Optionally, compared with each first ring, the plurality of second rings are far away from the center of the lens; the first parameter gradually increases from the first value to the second value from the edge of the lens to the center of the lens, and a second parameter is the first value; and the first parameter includes at least one of the following parameters: the sizes of the graphic units included in the first ring, the rotation angles of the graphic units included in the first ring, and the first interval; and the second parameter includes sizes of the plurality of graphic units included in the second ring, rotation angles of the plurality of graphic units included in the second ring, and the second interval.

Optionally, compared with each first ring, the plurality of second rings are close to the center of the lens; the first parameter gradually increases from the first value to the second value from the edge of the lens to the center of the lens, and a second parameter is the first value; and the first parameter includes at least one of the following parameters: the sizes of the graphic units included in the first ring, the rotation angles of the graphic units included in the first ring, and the first interval; and the second parameter includes sizes of the plurality of graphic units included in the second ring, rotation angles of the plurality of graphic units included in the second ring, and the second interval.

Optionally, the graphic unit is a center connection graphic, a ring-shaped graphic, or a filled graphic.

Optionally, a sum of lengths of arms connected to a central point of the center connection graphic is 0.5 time to twice a wavelength of a transmitted electromagnetic wave; an outer circumference of the ring-shaped graphic is 0.5 time to twice the wavelength of the transmitted electromagnetic wave; and a circumference of the filled graphic is 0.5 time to twice the wavelength of the transmitted electromagnetic wave.

Optionally, the substrate layer is made of a dielectric material, and the dielectric material includes resin, glass, or ceramic.

Optionally, the convex surface or the concave surface of the substrate layer is a stepped surface.

In this embodiment of this application, a conventional device and a conventional manufacturing process may be used for lens manufacturing, and no additional system loss is caused.

In the technical solutions of this application, a metal graphics array is added to a single surface or two surfaces of a dielectric lens, a metal graphic makes a transmitted electromagnetic wave generate a phase shift, and a phase difference is generated for the transmitted electromagnetic wave due to a size, location, or angle change of the metal graphic, the phase difference is generated by combining a structural parameter change of the metal graphic and a medium thickness change, instead of originally depending only on a medium thickness change. In this way, a thickness of a central part of the dielectric lens can be greatly reduced.

The foregoing descriptions are merely specific implementations of this application, but are not intended to limit the protection scope of this application. Any variation or replacement readily figured out by a person skilled in the art within the technical scope disclosed in this application shall fall within the protection scope of this application. Therefore, the protection scope of this application shall be subject to the protection scope of the claims.

What is claimed is:

1. A lens, comprising a substrate layer and a metal layer, wherein at least one surface of the substrate layer is a concave surface or a convex surface;

the metal layer exists on the at least one surface of the substrate layer;

the metal layer comprises a metal part and a hollow-out part, and the metal part or the hollow-out part is presented by using a graphics array;

the graphics array comprises a plurality of first rings, the first ring comprises a plurality of graphic units, and a larger ring encircles a smaller ring in the plurality of first rings; and at least one of the following are different: size of graphic units comprised in two adjacent first rings, rotation angle of graphic units comprised in two adjacent first rings, or two adjacent first intervals, wherein the first interval is an interval between the two adjacent first rings.

2. The lens according to claim 1, wherein graphic units comprised in a same first ring have a same size and a same rotation angle.

3. The lens according to claim 1, wherein a first parameter gradually increases from a first value to a second value from an edge of the lens to a center of the lens; and the first parameter comprises at least one of the following parameters: sizes of the graphic units comprised in the first ring, rotation angles of the graphic units comprised in the first ring, and the first interval.

4. The lens according to claim 1, wherein a first parameter periodically changes from an edge of the lens to a center of the lens, and the first parameter gradually increases from a first value to a second value in each change periodicity; and the first parameter comprises at least one of the following parameters: sizes of the graphic units comprised in the first ring, rotation angles of the graphic units comprised in the first ring, and the first interval.

5. The lens according to claim 1, wherein the graphics array further comprises a plurality of second rings, the second ring comprises a plurality of graphic units, and a larger ring encircles a smaller ring in the plurality of second rings and the plurality of first rings;

graphic units comprised in two adjacent second rings have a same size and a same rotation angle, and two adjacent second intervals are the same, wherein the second interval is an interval between the two adjacent second rings;

at a location corresponding to an area in which the plurality of first rings are located, a thickness of the substrate layer remains unchanged; and at a location corresponding to an area in which the plurality of second rings are located, the thickness of the substrate layer gradually increases from the edge of the lens to the center of the lens.

6. The lens according to claim 5, wherein graphic units comprised in a same second ring have a same size and a same rotation angle.

7. The lens according to claim 5, wherein compared with each first ring, the plurality of second rings are far away from the center of the lens;

the first parameter gradually increases from the first value to the second value from the edge of the lens to the center of the lens, and a second parameter is the first value; and the first parameter comprises at least one of the following parameters: the sizes of the graphic units comprised in the first ring, the rotation angles of the graphic units comprised in the first ring, and the first interval; and the second parameter comprises sizes of the plurality of graphic units comprised in the second ring, rotation angles of the plurality of graphic units comprised in the second ring, and the second interval.

8. The lens according to claim 5, wherein compared with each first ring, the plurality of second rings are close to the center of the lens;

the first parameter gradually increases from the first value to the second value from the edge of the lens to the center of the lens, and a second parameter is the second value; and the first parameter comprises at least one of the following parameters: the sizes of the graphic units comprised in the first ring, the rotation angles of the graphic units comprised in the first ring, and the first interval; and the second parameter comprises sizes of the plurality of graphic units comprised in the second ring, rotation angles of the plurality of graphic units comprised in the second ring, and the second interval.

9. The lens according to claim 1, wherein the graphic unit is a center connection graphic, a ring-shaped graphic, or a filled graphic.

10. The lens according to claim 9, wherein a sum of lengths of arms connected to a central point of the center connection graphic is 0.5 time to twice a wavelength of a transmitted electromagnetic wave;

an outer circumference of the ring-shaped graphic is 0.5 time to twice the wavelength of the transmitted electromagnetic wave; and a circumference of the filled graphic is 0.5 time to twice the wavelength of the transmitted electromagnetic wave.

11. The lens according to claim 9, wherein the center connection graphic comprises two long arms and four short arms; and the two long arms are cross-connected, each end of the long arm is connected to a central location of one short arm, the two long arms and the four short arms are located on a same plane, and the long arm is perpendicular to the connected short arm.

12. The lens according to claim 11, wherein lengths of short arms of center connection graphics comprised in the two adjacent first rings are different.

13. The lens according to claim 9, wherein the ring-shaped graphic comprises an open resonant ring.

14. The lens according to claim 9, wherein outer circumferences of ring-shaped graphics comprised in the two adjacent first rings are different.

15. The lens according to claim 9, wherein circumferences of filled graphics comprised in the two adjacent first rings are different.

16. The lens according to claim 1, wherein a material of the substrate layer comprises resin, glass, or ceramic.

17. The lens according to claim 1, wherein the convex surface or the concave surface of the substrate layer is a stepped surface.

18. A lens antenna, comprising:

a feed and a lens;

wherein the feed is configured to radiate an electromagnetic wave and the feed is disposed on a focal plane of the lens; and wherein the lens comprises a substrate layer and a metal layer, wherein at least one surface of the substrate layer is a concave surface or a convex surface;

the metal layer exists on the at least one surface of the substrate layer;

the metal layer comprises a metal part and a hollow-out part, and the metal part or the hollow-out part is presented by using a graphics array;

the graphics array comprises a plurality of first rings, the first ring comprises a plurality of graphic units, and a larger ring encircles a smaller ring in the plurality of first rings; and at least one of the following are different: size of graphic units comprised in two adjacent first rings, rotation angle of graphic units comprised in two adjacent first rings, or two adjacent first intervals, wherein the first interval is an interval between the two adjacent first rings.

19. A remote radio unit (RRU), comprising the lens antenna according to claim 18.

* * * * *